United States Patent [19]

Menter et al.

[11] 4,010,497

[45] Mar. 8, 1977

[54] TOILET SPLASH GUARD

[76] Inventors: Philip Menter, 503 Hillsboro Parkway, Syracuse; Herbert Bauer, 206 Stoneridge Drive, Dewitt, both of N.Y. 13214

[22] Filed: May 20, 1974

[21] Appl. No.: 471,703

[52] U.S. Cl. ..... 4/1; 4/109; 4/222; 4/243

[51] Int. Cl.[2] ..... A47K 17/00

[58] Field of Search ..... 4/1, 139, 141, 142, 4/138, 110, 111, 112, 113, 222, 243, 109

[56] References Cited

UNITED STATES PATENTS

| | | | |
|---|---|---|---|
| 1,144,660 | 6/1915 | Mcknight | 4/139 |
| 3,176,317 | 4/1965 | Kelseaux | 4/1 |
| 3,263,241 | 8/1966 | Saulson | 4/112 |
| 3,383,710 | 5/1968 | Sumner | 4/1 |
| 3,546,716 | 12/1970 | Laumann | 4/112 |
| 3,654,064 | 4/1972 | Laumann | 4/112 X |

*Primary Examiner*—Henry K. Artis
*Attorney, Agent, or Firm*—Holman & Stern

[57] ABSTRACT

A coated paper product which is shaped so as to conform with the shape of the exposed surface area of the water in a commode, which paper is biodegradable and contains coated or impregnated thereon a biocidal and/or germicidal material, and which paper effectively eliminates the splash of the commode water upon the deposition of fecal matter on the surface thereof.

2 Claims, 3 Drawing Figures

TOILET SPLASH GUARD

BACKGROUND OF THE INVENTION

The instant invention is directed to a disposable product usable to eliminate the splash which results when a mass breaks the surface of a quiet body of water. It is well known that when any solid and/or liquid comes in contact with the surface of a quiet body of water, a splash and/or rebound effect is the result. Such an effect can be undesirable and, under certain circumstances, dangerous.

In particular, when the surface of the water contained in a commode is disturbed by the deposition of excreted materials, the resulting effect is splash. The splash can spread the water contained therein so that said water comes into contact with the skin of the person using the commode. In as much as the water so spread has been in contact with germ-containing human urine and fecal matter, it can and does have a high risk of spreading disease.

One such disease, cervico vaginitis, has been associated with micro organisms such as those contained in a commode. Leukorrhea is not in itself a disease but a symptom of some disorder in the genital tract or elsewhere in the body. Infection of the vagina or cervix with bacteria, protozoa, or fungi is the direct cause. Predisposing causes are parasitic infection, foreign body, pelvic congestion, endocrine disturbances, postmenopausal atrophy, unhealed lacerations, hypersecretion, uncleanliness, and chemical or thermal factors or X-irradiation. However, Trichomonas vaginalis infection probably is the most frequent direct cause of the discharge. Many cases are due to infection with Candida (Monilia) organisms. Gonococcal, spirochetal, staphylococcal, streptococcal, pneumococcal and tuberculous infections are less common causes.

The secretions which result may come from the vulva, vagina, cervix, or fundus. *T. vaginalis*, *C. albicans*, gonorrheal, postabortive and puerperal infections are the usual contributing factors. When the discharge is profuse, yellowish in color and associated with burning or urination, gonorrhea must be considered in the differential diagnosis. The irritating, profuse discharge which causes itching usually is due to *T. vaginalis* or a fungus.

OBJECTIVE OF THE INVENTION

One method of eliminating the spread of such diseases is to eliminate the splash which results from the deposition of fecal matter and urine on the surface of a commode.

Therefore, it is an object of this invention to provide a paper which eliminates the splash which results from the deposition of urine and fecal matter on the surface of a commode.

Another object of this invention is to provide a disposable paper which eliminates the splash which results from the deposition of urine and fecal matter on the surface of a commode.

A further object of this invention is to provide a biodegradable paper which eliminates the splash which results from the deposition of urine and fecal matter on the surface of a commode.

A still further object of this invention is to provide a paper product which, in addition to eliminating a splash from a commode upon deposition of urine and fecal matter, also disinfects the water contained therein.

PREFERRED EMBODIMENT

The subject invention is described more particularly with reference to the accompanying drawings which form an integral part of this disclosure.

Figure 1:
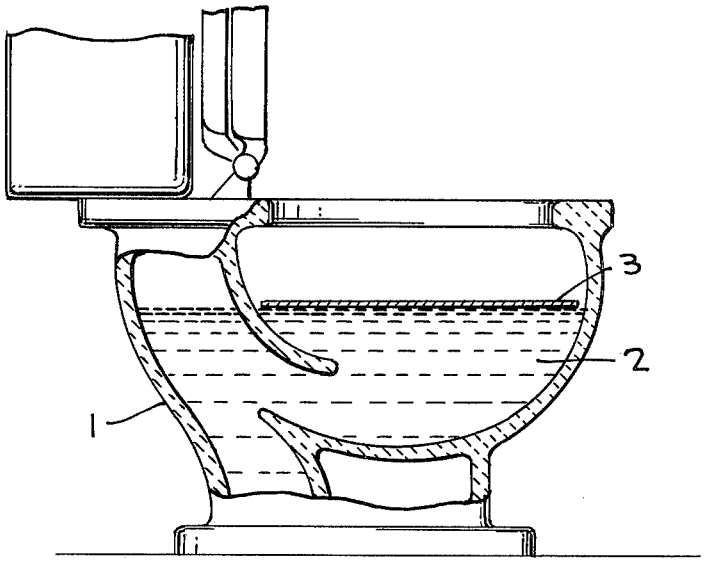
FIG. 1 shows a side view of a commode with the subject anti-splash paper in place.

Referring now in detail to the drawings noted above, FIG. 1 shows a commode. The particular size and/or shape of said commode is irrelevant to the utility of said invention inasmuch as said anti-splash papers may be shaped to conform to an exposed water surface created thereby. As shown, the anti-splash paper (3) rests on the surface of the water (2) so as to minimize any splash created by the deposition of material on the exposed surface thereof.

Figure 2:
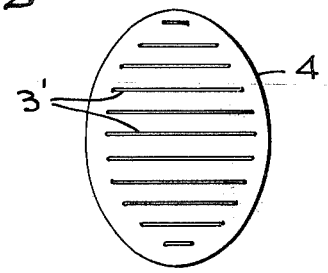
FIG. 2 is a top view of an embodiment of the subject splash paper.

The subject anti-splash papers contain scores or precut areas on the surface thereof as shown in FIG. 2. The cuts (3)′ in the anti-splash paper (4) are designed so as to permit the passage of urine and/or fecal matter through the surface thereof to the water beneath said anti-splash paper. Such passage facilitates the disposal of the excreta which is flushed completely with the anti-splash paper following.

Figure 3:
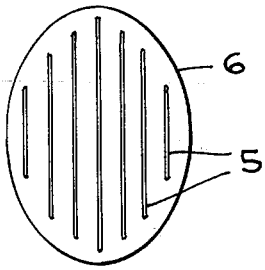
FIG. 3 is another top view of a further embodiment of the subject splash paper.

In FIG. 3, another manner of slitting the surface of the anti-splash paper (5) is with longitudinal slits (6) as opposed to horizontal slits. In this connection, it is noted that the direction and manner of perforating the subject anti-splash papers is not critical to the operation of the subject invention. It is preferred, however, that said perforation be of such a type which allows the rapid passage of excreta therethrough while not being so large as to defeat the purpose of the subject invention, i.e., not so large as to permit a splash to occur.

The subject papers may be made from either single and/or multiple pieces. While it is preferred to employ a single sheet thereof, the only critical factor is that said sheets must be biodegradable so that the subject invention is usable in connection with today's modern sewage disposal systems. Such biodegradable papers are well known in the Art and their production and manufacture are also well known.

It is noted that said papers may or may not be impregnated or coated with any one of a number of materials. Such impregnating materials include, but are not limited to, coloring agents, perfumes, germicides, disinfectants, brocides, and/or detergents. Preferably the subject anti-splash papers are impregnated with a germicide, biocide and/or disinfectant which is released into the commode water so as to eliminate bacteria, protozoa, and/or fungal organisms which may be present therein. Such useful materials include, but are not limited to:

a. anionic synthetic detergents, as represented by sodium alkyl sulfates, sodium or potassium alkylbenzenesulfonates, sodium alkylglycerylethersulfonates, and others;

b. nonionic synthetic detergents, as represented by polyethylene oxide condensates of alkylphenols; condensation products of aliphatic alcohols of 8 to 18 carbon atoms with ethylene oxide; long chain tertiary amine oxides corresponding to the general formula $R_1R_2R_3N \rightarrow O$ wherein $R_1$ is an alkyl radical of about 8 to 18 carbon atoms with $R_2$ and $R_3$ being methyl or ethyl radicals; long chain tertiary phosphate oxides corresponding to the general formula $R_4R_5R_6P \rightarrow O$, wherein $R_4$ is an alkyl, alkenyl or monohydroxyalkyl radical of about 10 to 18 carbon atoms with $R_5$ and $R_6$ being alkyl or monohydroxyalkyl groups of 1 to 3 carbon atoms;

c. Ampholytic synthetic detergents, as represented by the derivatives of aliphatic amines which contain about 8 to 18 carbon atoms and an anionic water solubilizing group (e.g., carboxy, sulfo, sulfato); and, d. Zwitterionic synthetic detergents, represented by derivatives of aliphatic quaternary ammonium compounds, wherein one of the aliphatic groups has about 8 to 18 carbon atoms, another contains a water-solubilizing group, and any of which are straight or branched.

e. Cationic synthetic detergents represented by alkyldimethylbenzylammonium chloride, benzyldimethyltetramethylbutylphenoxyethoxyethylammonium chloride, hexadecylpyridinium chloride, benzyldimethyltetramethylbutyltolyloxyethoxyethylammonium chloride.

The anionic, nonionic, ampholytic, and Zwitterionic detergents may be used singly or in combination together with the present invention. In addition, one may also employ materials including, but not limited to substituted phenols such as cresol, thiobisdichlorophenol, chlorothymol, hexachlorophene, hexylresorcinolchlorophenolresorcinol, and the like. Halogen compounds including iodine, iodochlorhydroxyquin, triiodomethane, the disodiumsalt of dibromohydroxymercurifluorescein, chloramine, dichloramine, and iodophors may also be employed either alone or in combination with each other or additional materials. It is further noted that there are numerous other materials which are antiseptic, germicidal, bactericidal, bacteriostatic, fungicidal and the like which may be employed either singly or in combination.

The subject anti-splash papers are utilized by removing same from a suitable dispenser and applying said anit-splash paper to the surface of the water in the commode to be used. Said papers, because of their shape, perforations, and coatings, rest on the surface of the commode water without sinking. The user is then free to excrete therein without being splashed. The excreta and biodegradable anti-splash paper are then disposed of by flushing the commode.

The use of the subject invention is safe from concern over disease which can result as a consequence of contact with germ-laden commode water.

The embodiments of the invention in which an exclusive property or privilege is claimed are defined as follows:

1. An anti-splash device comprising biodegradable paper in sheet form shaped to conform to the area of the exposed surface of the water contained in a commode and floatable on the water surface, said paper including precut means dimensioned to allow the passage of human excreta therethrough.

2. The anti-splash device of claim 1 which is impregnated with a member selected from the group consisting of a biocide, a germicide and disinfectant.

* * * * *